US006771927B2

(12) United States Patent
Bloemen et al.

(10) Patent No.: US 6,771,927 B2
(45) Date of Patent: Aug. 3, 2004

(54) TONER UNIT DRIVE ELEMENT FOR IMPROVED INSERTION

(75) Inventors: Peter J. M. Bloemen, Cuijk (NL); Ludovicus A. M. Nooyens, Eindhoven (NL)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/318,613

(22) Filed: Dec. 12, 2002

(65) Prior Publication Data

US 2004/0114977 A1 Jun. 17, 2004

(51) Int. Cl.[7] ..... G03G 21/10; G03G 15/08

(52) U.S. Cl. ..... 399/358; 399/256

(58) Field of Search ..... 399/119, 120, 399/123, 167, 254, 256, 263, 343, 358, 359, 360; 366/244, 247, 252, 272, 279, 283, 318, 342, 343

(56) References Cited

U.S. PATENT DOCUMENTS 4,473,028 A * 9/1984 Ito et al. ..... 399/254
4,894,688 A * 1/1990 Taniguchi et al. ..... 399/359
5,036,369 A * 7/1991 Toda et al. ..... 399/359
5,541,714 A * 7/1996 Watanabe et al. ..... 399/120
5,845,175 A 12/1998 Kumar et al. ..... 399/111
5,920,753 A 7/1999 Sasaki et al. ..... 399/111
5,937,241 A 8/1999 Kumar et al. ..... 399/111
6,058,280 A 5/2000 Kumar et al. ..... 399/117
6,654,580 B2 * 11/2003 Yamaguchi et al. ..... 399/167

* cited by examiner

*Primary Examiner*—Sandra L. Brase
(74) *Attorney, Agent, or Firm*—David J. Arthur

(57) ABSTRACT

A replaceable toner cartridge for a printing apparatus includes a waste toner auger rotationally driven by a printer drive gear. The auger includes a drive element for engaging the printer drive gear. The auger drive element includes drive paddles extending radially from the auger shaft. Each drive paddle has a radial edge adjacent an inclined radial face surface, so that the as the auger drive element and the printer drive gear axially engage one another, the drive paddles of the auger drive element and the gear lobes of the printer drive gear slide along one another until the auger drive element and the printer drive gear solidly engage one another. Each drive paddle also has an extension perpendicular to the radial direction of the paddle to increase the spacing between the axial engagement surface of the printer drive gear and the radial edge of the drive element paddle.

11 Claims, 6 Drawing Sheets

TONER UNIT DRIVE ELEMENT FOR IMPROVED INSERTION

TECHNICAL FIELD

The present invention relates to xerographic printing apparatus, and more specifically to a transport device used in removing waste toner from such an apparatus.

BACKGROUND

The basic principles of electrostatographic printing with dry marking material (generally referred to as xerography) are well known: an electrostatic latent image is created on a charge-retentive surface, such as a photoreceptor or other charge receptor, and the latent image is developed by exposing it to a supply of toner particles, which are attracted as needed to appropriately-charged areas of the latent image. The toner particles are then transferred in imagewise fashion from the photoreceptor to a print sheet, the print sheet being subsequently heated to permanently fuse the toner particles thereto to form a durable image.

Following the transfer of the image from the photoreceptor to the print sheet, residual toner particles remaining on the photoreceptor are removed by any number of known means, such as a cleaning blade, brush, and/or vacuum. In a typical embodiment, the removed toner is accumulated in a hopper. Accumulated waste toner is directed, typically by an auger, into a waste container.

Elements described herein relate to aspects of a module which is readily removable and insertable in a xerographic printing apparatus, such as a "laser" printer or copier. The module includes many of the well-known elements used in the xerographic process, such as a photoreceptor; a corotron for initial charging of the photoreceptor; a transfer and a detack corotron; a cleaning blade; and an auger-based device for removing waste toner that has been removed from the photoreceptor by the cleaning blade.

DETAILED DESCRIPTION

Figure 1:
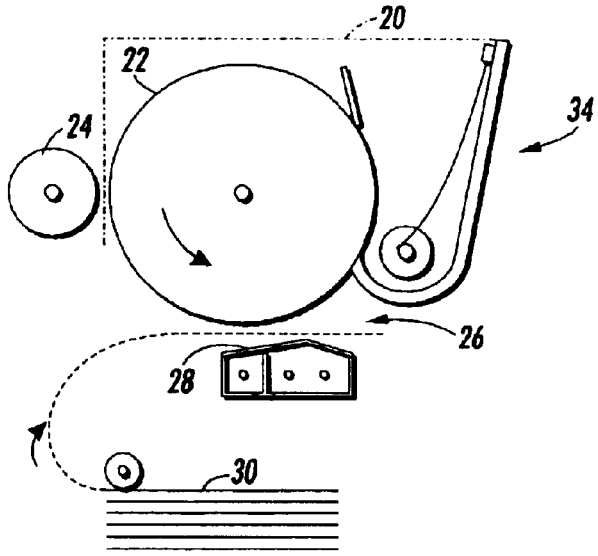
FIG. 1 is a simplified elevational view showing relevant elements of an electrostatographic or xerographic printing apparatus, many of which are disposed within a module.

FIG. 1 is a simplified elevational view showing elements of an electrostatographic or xerographic printing apparatus many of disposed within a module housing generally shown as 20. As is well known, an electrostatic latent image is created, by means not shown, on a surface of a charge receptor or photoreceptor 22. The photoreceptor 22 can be a drum (as shown) or a flexible belt. The latent image on the photoreceptor is developed by applying thereto a supply of toner particles, such as with developer roll 24. The developer roll can be of any of various designs such as a magnetic brush roll or donor roll, as is familiar in the art. The toner particles adhere to the appropriately-charged areas of the latent image on the photoreceptor 22. The surface of the photoreceptor 22 then moves, as shown by the arrow, to a transfer zone 26 created by a transfer-detack assembly generally indicated as 28. Simultaneously, a print sheet on which an desired image is to be printed is drawn from supply stack 30 and conveyed to the transfer zone 26.

At the transfer zone 26, the print sheet is brought into contact or at least proximity with a surface of photoreceptor 22, which at this point is carrying toner particles thereon. A corotron or other charge source at transfer zone 26 causes the toner on the photoreceptor 22 to be electrically transferred to the print sheet. The print sheet is then sent to subsequent stations, as is familiar in the art, such as a fuser and finishing devices (not shown).

Figure 2:
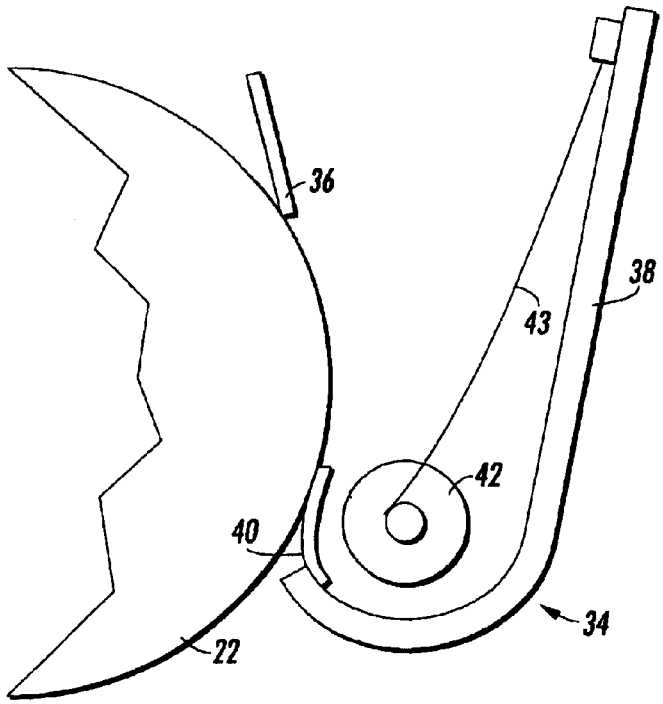
FIG. 2 is an elevational view of a cleaning station formed by part of the module of FIG. 1.

Following transfer of most of the toner particles to the print sheet in the transfer zone, any residual toner particles remaining on the surface of the photoreceptor 22 are removed at a cleaning station, which is generally indicated as 34. FIG. 2 is an enlarged elevational view of a cleaning station 34. As can be seen in FIG. 2, a cleaning blade 36 is urged against the surface of photoreceptor 22 and scrapes the residual toner off the surface. The toner thus removed falls downward into the housing 38 forming a hopper for accumulating the toner. A flexible flap seal 40, extending the length of the photoreceptor 22, prevents loose toner from escaping the hopper.

At the bottom of the hopper is an auger 42, here shown end-on. The auger extends substantially the length of the photoreceptor 22. The auger 42 is rotated and thus conveys toner particles at the bottom of the hopper to a waste container (not shown). An agitator 43, made of a thin, flexible material, can interact with the auger to clean the flanges or flights of the auger.

The auger 42 can be formed of a polycarbonate material with up to 20% glass fiber (preferably about 10%) and up to 20% PTFE (preferably 15%). The optimal proportion of PTFE will depend on the size and intended rotational speed of the auger 42. The housing 38 can be formed of a polycarbonate material with 10–30% glass fiber (preferably about 20%). This combination of materials for the auger and the housing enables the auger to rotate freely and reliably within the housing without the use of a bushing or any special mount for the auger 42. That is, an end of the auger 42 can simply be inserted into an opening 46 (FIG. 3) or indentation in a surface of the housing 38, and rotate freely without a bushing or other mechanism.

Figure 3:
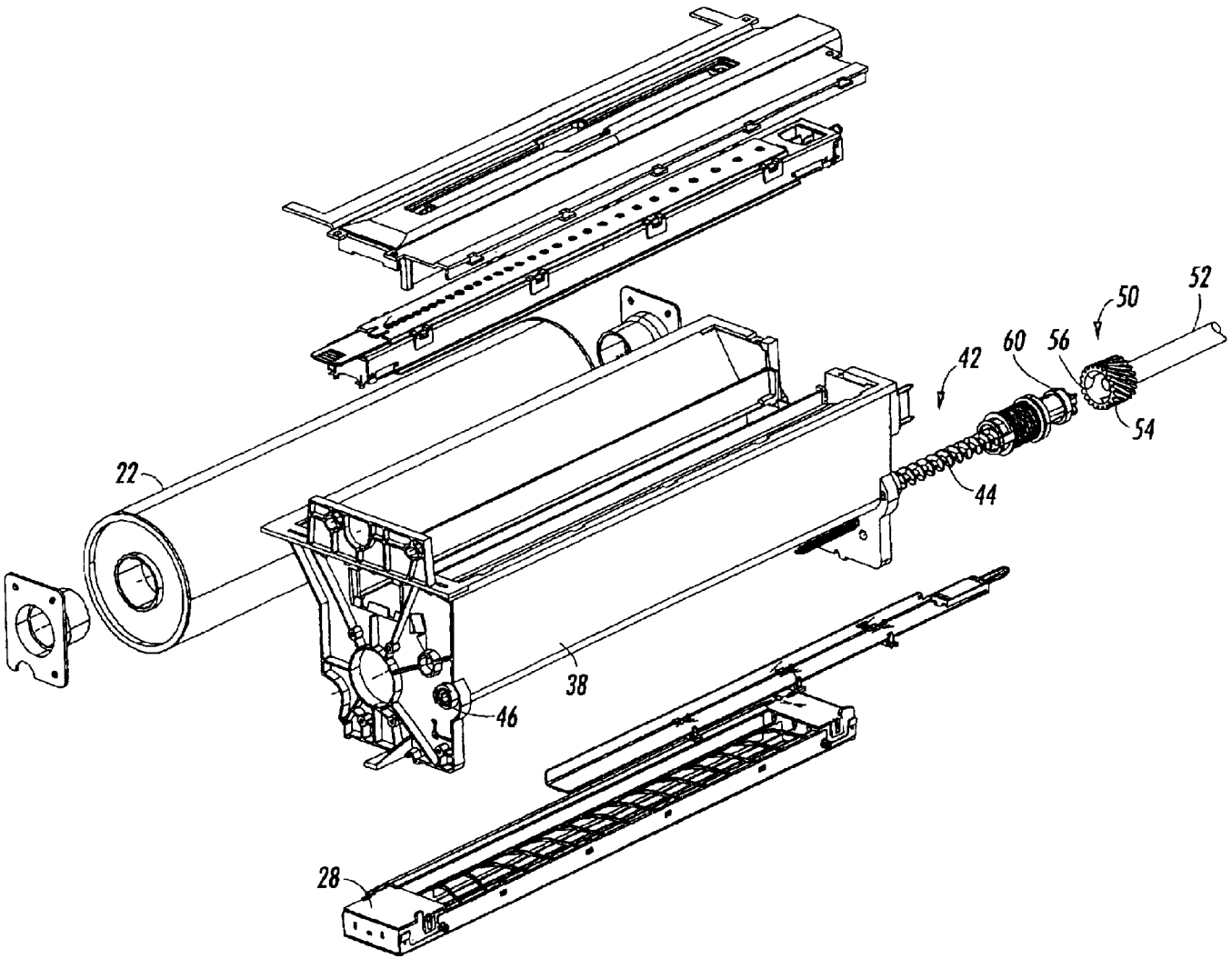
FIG. 3 is a partially exploded view of a practical embodiment of a module.

FIG. 3 is a partially exploded view of a practical embodiment of a module for an electrostatographic or xerographic printing apparatus. Indicated as 28 is the transfer/detack corotron assembly described above. As is well known, the corotron assembly include one or more electrodes, such electrodes comprising wires or pins (and, in some embodiments, a screen) for creating and directing ions to a surface of the photoreceptor 22.

The auger 42 includes a central elongate auger shaft with a central axis of rotation, and has a distal end that engages the opening 46 of the housing 38, and a drive end that engages a drive gear 50 of the printing device. One or more helical flights or flanges 44 extend along substantially the length of the auger shaft so that as the auger 42 rotates about its axis of rotation, the flights 44 convey the toner along the length of the auger to the waste container (not shown).

Figure 4:
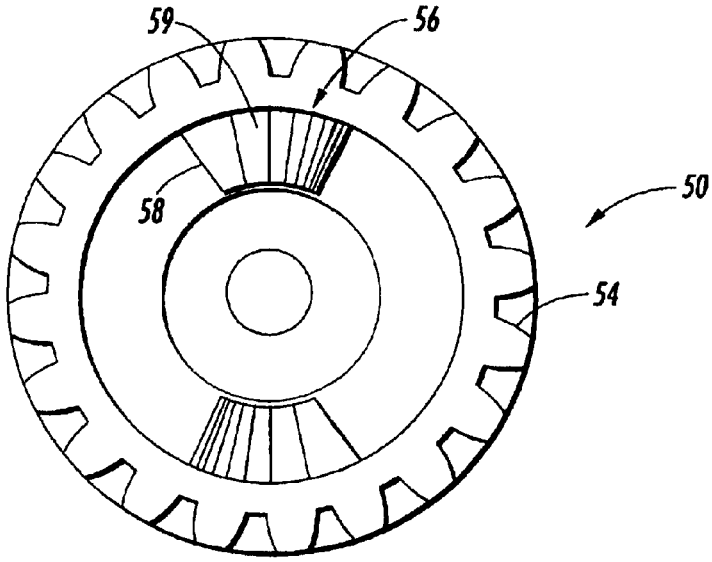
FIG. 4 is an elevational view of the end of a drive gear in a xerographic printing apparatus.

The printer drive gear 50 includes a drive shaft 52 and a gear body. The gear body has external gear teeth 54 and internal gear lobes 56. The internal gear lobes 56 of the drive gear engage a drive element 60 on the drive end of the auger 42. Referring to FIG. 4, the illustrated embodiment of the drive gear 50 has two internal gear lobes 56. Each gear lobe 56 has an axial engagement surface 58 that is substantially flat and extends along a radius of the gear 50. An inclined internal gear surface 59 extends circumferentially from the axial engagement surface. The inclined internal gear surface 59 inclines axially from the axial engagement surface 58.

Figure 5:
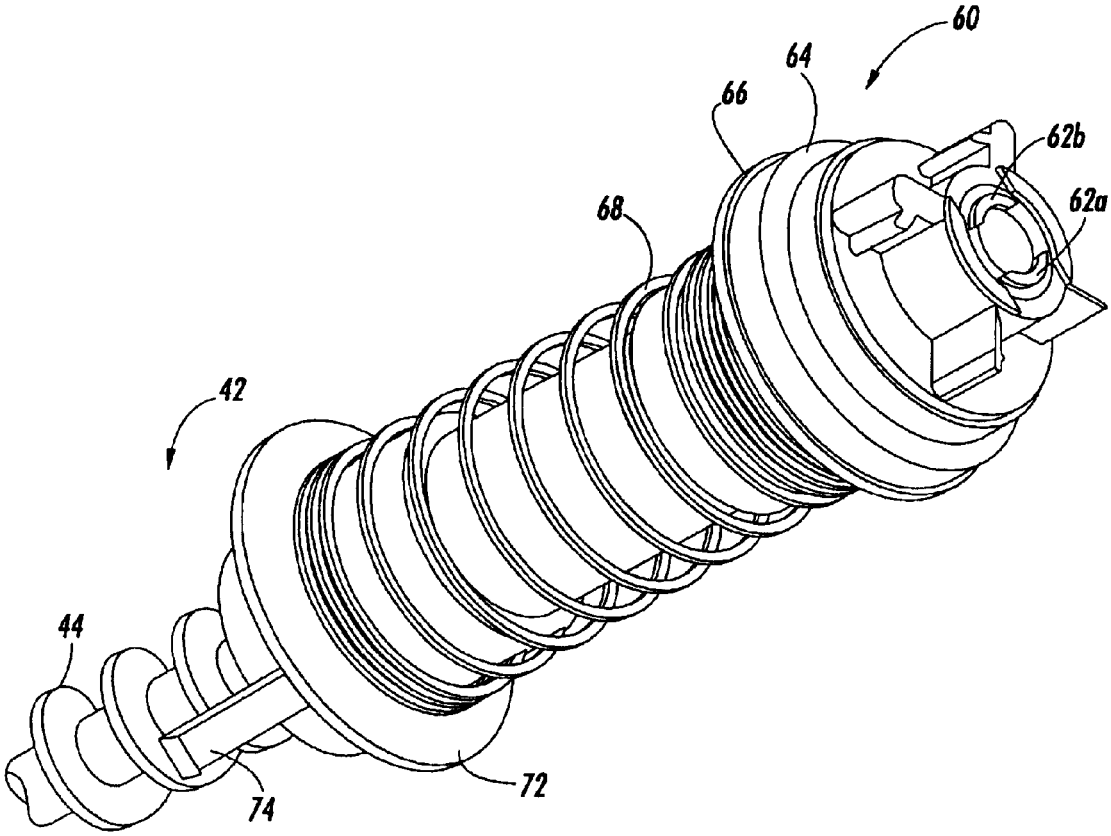
FIG. 5 is an enlarged view of an end portion of an auger for waste toner.

The drive end of the auger, with its drive element 60, is shown in greater detail in FIG. 5. The distal end of the auger shaft contains the drive element 60. In the illustrated embodiment, the drive end of the auger shaft is formed as arcs 62*a*, 62*b* spaced from one another so that they can be compressed, permitting a cylindrical drive element 60 to be slid over the drive end of the auger shaft. Once applied, the cylindrical drive element 60 securely engages the auger shaft, and the drive element 60 and auger shaft 62 rotate together as one about a central axis of rotation.

A seal on the auger may include a compliant foam seal element 64 backed by a rigid flange 66. A biasing element such as a coil spring 68 holds the seal in place against the interior surface of the module housing when the auger is properly installed in the module housing 38. An attachment mechanism such as a flange 72 and clips 74 holds the auger in place in the module housing. Numerous other arrangements can alternatively be used to hold the auger in place.

Figure 6:
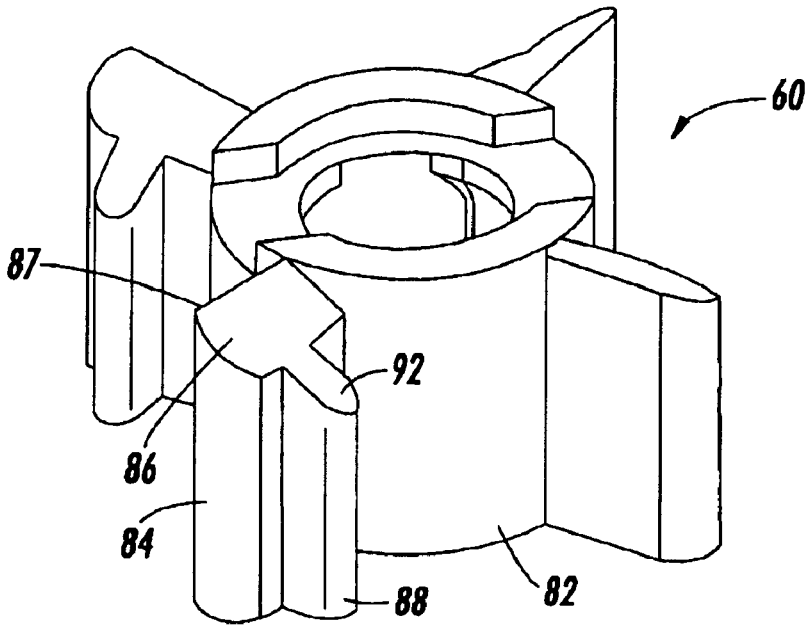
FIG. 6 is an elevational view of the drive element portion of the auger of FIG. 5.

Referring now to FIG. 6, the auger drive element 60 includes a cylindrical drive body 82 with one or more drive paddles 84 extending radially from the drive body. The illustrated embodiment contains four drive paddles spaced equidistant around the perimeter of the cylindrical drive body. Each drive paddle extends along a paddle radius, with its proximal side where the drive paddle attaches to the cylindrical drive body. Each drive paddle also has a distal side remote from the drive body: Each drive paddle has a radial paddle face 86 extending radially from the drive body 82 to the distal side of the drive paddle. In one implementation, the cylindrical drive element body 82 and the radial drive paddles are molded in plastic as a single body. Injection molding is one technique available for forming the auger drive element 60.

The radial paddle face 86 of each drive paddle has an elongate projection or edge 87 at the distal radial side of the paddle. This radial edge 87 can be a perimeter segment of a planar surface inclined in the axial direction forming the radial paddle face. In particular implementations, this projection 87 is substantially linear, and extends radially from the central cylindrical drive body 82. Preferably, the axial incline of the radial paddle face 86 is oriented in a cross-paddle direction that is substantially perpendicular to the radial direction of the paddle.

Figure 7:
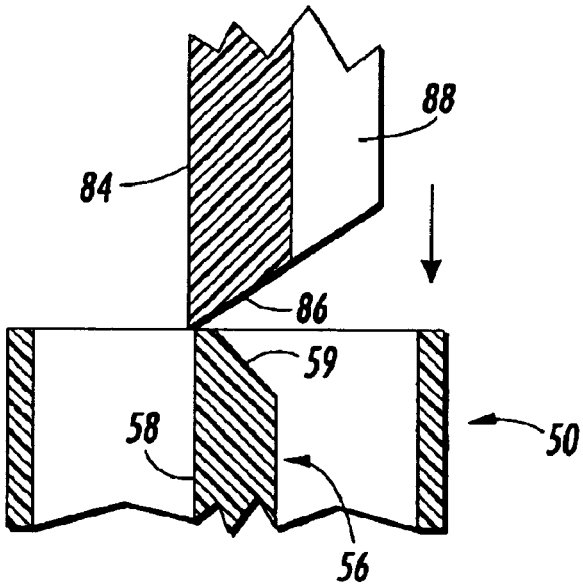
FIG. 7 is an enlarged cross-sectional view of an auger drive element paddle and a drive gear lobe near engagement.

FIG. 7 shows a representative drive paddle 84 of the auger drive element as it engages the drive gear 50 of the printing apparatus. As the auger moves axially to engage the gear, the sharp projection or edge 87 of the drive paddle 84 and the inclined radial paddle face 86 facilitate a sliding engagement of the drive paddle 84 and the gear lobe 56. As the inclined paddle face 86 slides along the peak of the gear lobe 56 adjacent the axial engagement surface 58 of the gear lobe, the drive element 60 rotates so that the drive paddle 84 slides into the gear 50 between gear lobes.

Figure 8:
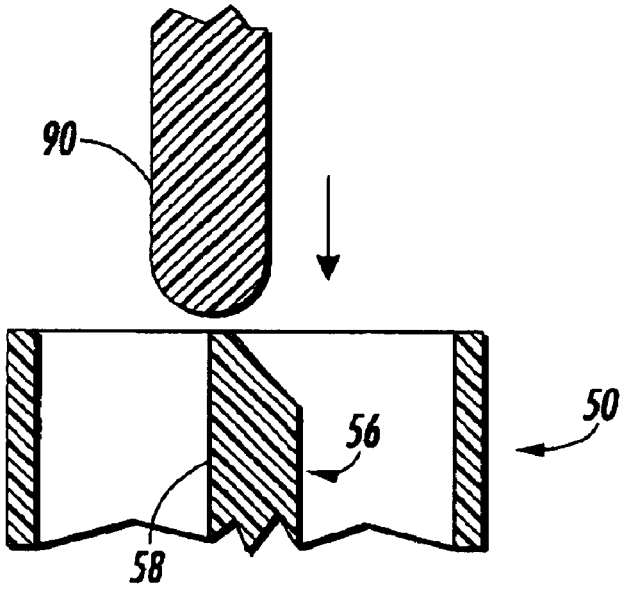
FIG. 8 PRIOR ART
FIG. 8 is an enlarged cross-sectional view of an auger drive element paddle of the prior art and a drive gear lobe near engagement.

The arrangements of the auger drive paddles 84 and the gear lobes 56 reduce the possibility that the radial end of the paddle will bind against the gear lobe as the auger drive element moves axially into the drive gear 50. Referring for example to the prior art paddle arrangement shown in FIG. 8, the end of the drive paddle 90 can bind against the end of the gear lobe 56, preventing smooth insertion of the auger drive element into the gear 50.

The radial edge 87 of the drive paddle 84 is preferably relatively sharp, presenting a minimum of "flat" surface facing in the axial direction. In many implementations, the technology of manufacturing will limit the sharpness of the radial edge 87.

Figure 9:
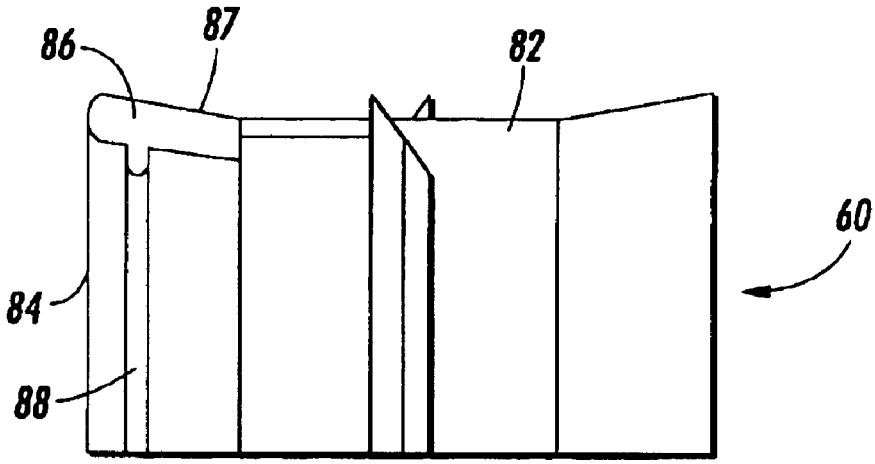
FIG. 9 is a side elevational view of the auger drive element portion of FIG. 6.

The radial projection or edge 87 of each drive paddle also inclines in the radial direction. As seen in FIG. 9, in a particular implementation, the radial edge at the distal side of the drive paddle 84 extends beyond the axial end of the central cylindrical drive body 82. In alternative implementations, the radial edge need not extend beyond the axial end of the cylindrical drive body 82, or the radial edge could incline in the opposite direction. The radial incline of the edge 87 further facilitates the smooth interaction of the auger drive paddle 84 and the internal gear lobe 56 of the drive gear. The combination of shapes of the radial edge of the auger drive paddle reduce the contact area between the auger drive paddles and the gear lobe 56 to a minimum (almost to a point), thereby minimizing potentially binding contact.

Referring again to FIG. 6, each radial paddle 84 of the auger drive element 60 additionally includes a paddle extension 88 that extends or projects in a substantially annular direction from a side of the paddle, in the cross-paddle direction (substantially perpendicular to the radial direction of the drive paddle). The paddle extension 88 causes the main body of the drive element radial paddle, and in particular the radial edge 87 to be spaced from the axial engagement surface 58 of the gear lobe when the auger drive element 60 and the printing apparatus gear 50 engage one another. Such spacing of the auger drive element paddle and the gear lobe substantially prevents the drive element and the gear from binding against one another when they are disengaged and then re-engaged. In particular, during operation of the auger, the auger is subject to torsional forces. As the printer module containing the auger is removed from its operational position (disengaging the auger drive element 60 from the printer gear 50), the drive element 60 tends to rotate about its rotational axis a small amount. Such rotation in prior arrangements has been prone to leave the auger drive paddles in a position closely aligned with the gear lobe 56 (similar to the position shown in FIG. 8), so that when the printer module is reinserted into operational position, the auger drive element paddle tends to bind against the gear lobe. The dimension of the paddle extension 88 in the radial direction of the paddle is less than the dimension of the paddle 84 itself so that the paddle extension 88 occupies only a portion of the side of the paddle.

Figure 10:
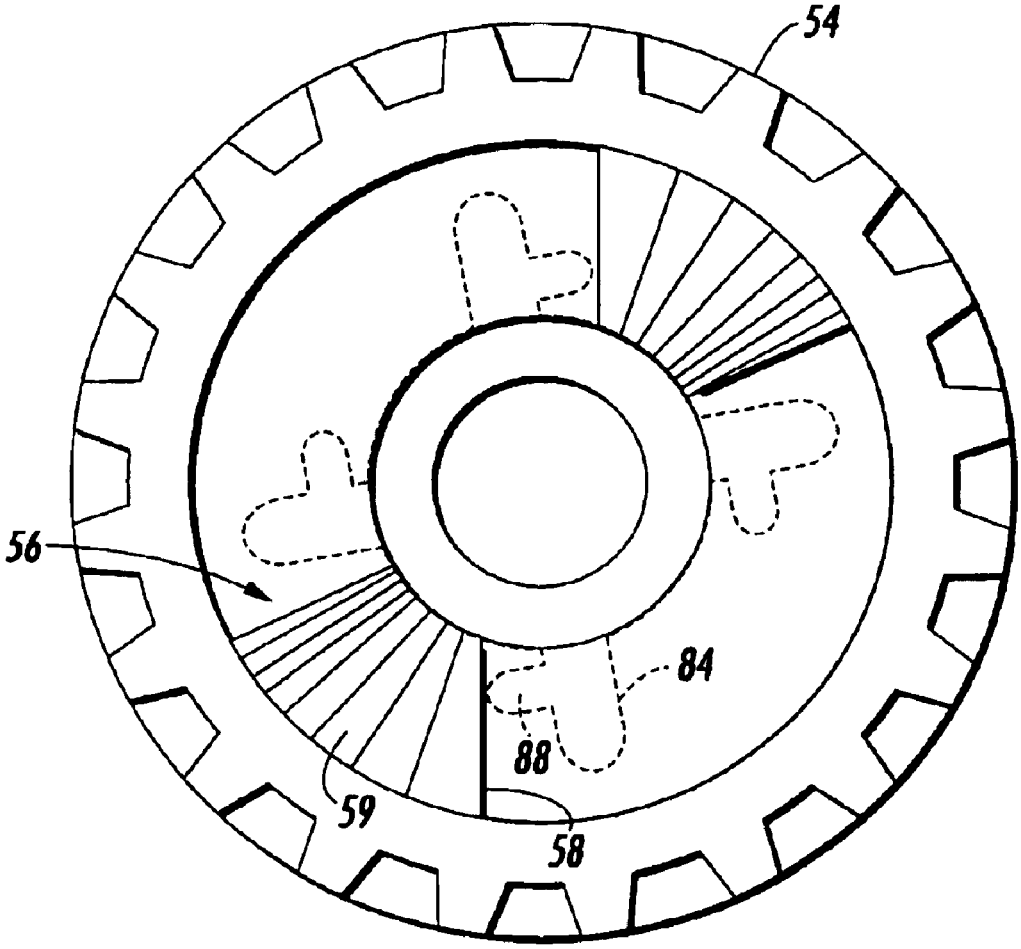
FIG. 10 is an end cross-sectional view of the drive gear, and auger drive element portion engaged.

The radial face 92 of the paddle extension is preferably substantially flush with the radial paddle face 86 of the main body of the radial paddle. In the illustrated embodiment, the paddle extension extends from the axial side of the paddle forming an oblique angle with the slanted radial surface 86. When the auger drive element 60 engages the printing apparatus gear 50, the distal end of the paddle extension preferably abuts the axial engagement surface 58 of the gear. FIG. 10 is an end view of the printer drive gear 50 with the auger drive element engaged. FIG. 10 illustrates the drive paddles 84 (and the paddle extensions 88 in particular) engaging the axial engagement surfaces 58 of the printer drive gear 50.

In a particular implementation, the outer diameter of the cylindrical portion 82 of the drive element is approximately 0.9 cm. Each drive paddle 84 extends approximately 0.4–0.5 cm in a radial direction. The drive paddle is approximately 0.1 cm thick (in the cross-paddle direction perpendicular to the radial direction). Each paddle extension 88 extends approximately 0.2 cm from the drive paddle. However, numerous other dimensions can be implemented, depending on the size and performance requirements of the auger.

One particular implementation of the toner unit auger drive element has been described and shown. Numerous modifications can be made to the specific implementation described without departing from the principle of the invention. For example, a different number of paddles can be included. A wide range of shapes can be used for the individual drive element paddles and paddle extensions. In addition, based upon the teaching above, those skilled in the art will recognize that the drive element described can be used in applications other than auger drives for toner cartridges. For example, the drive element can be used beneficially in other arrangements in which a rotational torque is applied to the drive element, and it is called for on at least some occasions to axially remove the drive element and replace it. Therefore, the claimed invention is not limited to the details of the implementation described above.

We claim:

1. A rotational drive element for engaging a drive gear in a printing device, the rotational drive element comprising:

a drive body having an axis of rotation defining an axial direction; and a plurality of paddles extending radially from the drive body;

wherein each paddle extends along a paddle radius;

wherein each paddle has a proximal side at which the paddle attaches to the drive body and a distal side remote from the drive body;

wherein each paddle has a radial paddle face extending along the paddle radius between the proximal side and the distal side; and wherein the radial paddle face of each paddle slopes in the axial direction;

wherein the radial paddle face slopes in a cross-paddle direction substantially perpendicular to the paddle radius; and wherein each paddle additionally includes a paddle extension extending in the cross-paddle direction.

2. The rotational drive element of claim 1, wherein a face of each paddle extension is substantially flush with the radial paddle face of the corresponding paddle.

3. A rotational drive element for engaging a drive gear in a printing device, the rotational drive element comprising:

a drive body having an axis of rotation defining an axial direction; and a plurality of paddles extending radially from the drive body;

wherein each paddle extends along a paddle radius;

wherein each paddle has a proximal side at which the paddle attaches to the drive body and a distal side remote from the drive body;

wherein each paddle has a radial paddle face extending along the paddle radius between the proximal side and the distal side; and wherein the radial paddle face of each paddle slopes in the axial direction;

wherein each paddle has a cross-paddle direction substantially perpendicular to the paddle radial direction;

wherein the radial paddle face of each paddle slopes axially in the cross-paddle direction;

wherein each paddle includes a paddle extension extending from the paddle in the cross-paddle direction;

wherein the dimension of the paddle extension in the radial direction is less than the dimension of the paddle in the radial direction; and wherein each paddle extension has a paddle extension face that is substantially flush with the radial paddle face of the corresponding paddle.

4. The rotational drive element of claim 3, wherein the paddle extension face slopes axially in the cross-paddle direction.

5. An auger for replaceable module of a printing device, the auger comprising:

an auger shaft;

at least one flight extending along at least a portion of the length of the auger shaft;

a drive body having an axis of rotation attached to one end of the auger shaft;

a plurality of paddles extending radially from the drive body; and a paddle extension extending in a substantially annular direction from each paddle;

wherein each paddle extends along a paddle radius;

wherein each paddle has a radial edge along the paddle radius;

wherein each paddle has a perpendicular directions substantially perpendicular to the paddle radius;

wherein each paddle has a radial paddle face along the paddle radius; and wherein the radial paddle face of each paddle is inclined in the perpendicular direction from the radial edge.

6. The auger of claim 5, wherein:

the radial edge of each paddle is along one radial side of the paddle;

the paddle extension extends from a side of the paddle opposite the paddle side having the radial edge.

7. The auger of claim 6, wherein the paddle extension has an extension face that is inclined in the paddle perpendicular direction.

8. The auger of claim 7, wherein the paddle extension has a dimension along the paddle radius less than the dimension of the paddle in the paddle radius.

9. The auger of claim 8, wherein the radial edge of each paddle is radially inclined.

10. A replaceable toner cartridge of a printing device, the toner cartridge comprising:

a housing;

an auger attached to the housing, wherein the auger comprises:

an elongate auger shaft having an axis of rotation and having a drive end and a distal end;

one or more flanges extending radially from the auger shaft along the length of the auger shaft;

a plurality of drive paddles extending radially from the drive end of the auger shaft;

wherein:

each drive paddle extends along a paddle radius;

each drive paddle has a proximal end at which the paddle attaches to the drive body and a distal end remote from the drive body;

each drive paddle has a radial paddle face extending along the paddle radius;

the radial paddle face of each drive paddle axially inclines in a radial direction along the paddle radius and in a cross-paddle direction substantially perpendicular to the paddle radius;

each drive paddle includes a paddle extension extending in the cross-paddle direction; and a face of each paddle extension is substantially flush with the radial paddle face of the corresponding paddle.

11. The toner cartridge of claim 10, wherein the face of each paddle extension inclines in the cross-paddle direction.

* * * * *